United States Patent [19]

Newmar

[11] 3,935,865

[45] Feb. 3, 1976

[54] BRASSIERE

[76] Inventor: Julie Newmar, 12 Beekman Place, New York, N.Y. 10022

[22] Filed: Nov. 22, 1974

[21] Appl. No.: 526,319

[52] U.S. Cl. ..... 128/488; 128/494; 128/509; 128/510

[51] Int. Cl.[2] ..... A41C 3/00

[58] Field of Search ..... 128/425, 463, 488, 494, 128/507, 508, 509, 510, 511, 512; 2/67

[56] References Cited

UNITED STATES PATENTS

| | | | |
|---|---|---|---|
| 1,524,475 | 1/1925 | Case | 128/510 X |
| 2,388,757 | 11/1945 | Miller | 128/508 |
| 2,870,768 | 1/1959 | Robinson | 128/510 |
| 3,465,754 | 9/1969 | Lockwood et al. | 128/488 X |
| 3,574,520 | 4/1971 | Aldrich | 128/463 UX |
| 3,847,158 | 11/1974 | Guidoni | 2/67 X |

FOREIGN PATENTS OR APPLICATIONS

| | | | |
|---|---|---|---|
| 1,460,078 | 1/1969 | Germany | 2/67 |

*Primary Examiner*—Andrew V. Kundrat
*Assistant Examiner*—Moshe I. Cohen
*Attorney, Agent, or Firm*—Charles E. Baxley

[57] ABSTRACT

A brassiere has a body engaging band which extends across the wearer's chest under her breasts and terminates in two ends each under one arm of the wearer. Two cups are connected to the body engaging band and each cup is adapted to receive one of the wearer's breasts. Each of the cups terminates in an upper end which connects with at least two shoulder cords extendable over one shoulder of the wearer to connect to an end of the body engaging band. The ends of the body engaging band are connected to each other by a closure cord which preferably extends across the wearer's back. In an alternate brassiere for backless dresses, two closure cords are provided and each connects to one of the ends of the body engaging band and wraps around the wearer's waist so as to be connectable to each other at the wearer's front.

9 Claims, 10 Drawing Figures

BRASSIERE

BACKGROUND OF THE INVENTION

This invention relates to a brassiere for supporting breasts of a woman. Breasts of young women tend to be protuberant whereas breasts of older women tend to be pendulous. Protuberant breasts are supported by fibrous tissue strands known as ligaments of Astley Cooper. When the ligaments of Astley Cooper become overstretched or atrophic, the breasts droop. The breast tissue itself does not have muscular support, the ligaments of Astley Cooper connect deep fascia at the base of the breast with overlying skin. It is the function of a brassiere to provide support for the breast tissue (acting in concert with the ligaments of Astley Cooper).

Many women want to appear freer in their movements and to give a braless impression, yet they need some support. Support is needed particularly when the woman dances or participates in athletic events or the like. One approach to a braless impression by the prior art has been merely to make thinner and smaller conventional brassieres, but this approach does not yield desired freedom of movement for the wearer. Halter brassiere designs also have been employed, but halters require a sling over the nape of the wearer's neck and they generally provide more concealment than support.

ANALYSIS

Structurally breasts cantilever outwardly from a wearer's chest. Conventional brassieres generally provide a panel on the wearer's back whence straps extend over the wearer's shoulders to hold up her breasts. Of course these panels tend to hold in the wearer's sides but they are situated on muscles on the back of the wearer's trunk and they tend to restrict her motion and her circulation.

Mr. Howard Hughes, among others, developed brassieres which support breasts from below. It was discovered that little attention is paid to a wearer's chest below her breasts, so here was where Mr. Hughes situated major structural elements of his strapless brassieres. Coincidentally movement of a wearer's chest below her breasts is quite small compared with movement of her shoulders and movements of her back. Movement of the wearer's chest below her breasts is merely expansion and contraction of her rib cage resulting from breathing. Such movement is quite simple, being directed laterally across her chest.

This invention takes advantage of the wearer's chest below her breasts as a location for its body engaging band, because in that location the body engaging band is subjected merely to unidirectional tensioning stresses and the tensioning stresses are situated across the wearer's chest for minimum disruption of movement of the wearer. For this reason a brassiere according to the present invention tends to stay in place far better than a brassiere with back panels, because structural support in this brassiere eminates from a more stable base than in conventional brassieres. This invention permits the wearer to move her shoulders and back as freely as she wants to. Such movement is accommodated by employing a plurality of spaghetti cords from each cup of the brassiere over each shoulder. The spaghetti cords are spaced from each other so that the weight of the breast in the cup being supported thereby can be borne of either of the spaghetti cords depending upon motion of the wearer.

STATEMENT OF INVENTION

This invention has solved problems of the prior art in a particularly useful, novel, unobvious and facile way. A brassiere is presented which has a body engaging band extending across a wearer's chest under her breasts and which terminates in two ends, one each under one arm of the wearer. Two cups are connected to the band and each cup is adapted to receive one of the wearer's breasts. Each of the cups terminates in an upper end which connects with a pair of shoulder cords extendable over the respective shoulder of the wearer to connect to a respective end of the body engaging band. The ends of the body engaging band are connected to each other by a closure cord which extends across the wearer's back. In an alternate brassiere for backless dresses, two closure cords are each connected to one of the ends of the body engaging band and each of the closure cords wraps around the wearer's waist so that they are connectable to each other at the wearer's front.

Accordingly one object of this invention is to provide a brassiere which offers support with greater freedom of movement in such activities as dancing, athletics and the like, than has heretofore been available.

Another object of this invention is to provide a brassiere which is light in weight and which gives a braless effect.

Still another object of this invention is to allow a wearer's breasts some freedom for flexing.

Still another object of this invention is to provide a brassiere which is relatively undetectable, even through sheer outer garments.

Still another object of this invention is to provide a brassiere which accommodates molded, relatively transparent polyester (or like) cups whereby seams are obviated.

Still another object of this invention is to accommodate brassiere designs wherein impressions of a wearer's nipples are visible through sheer outer garments.

Still another object of this invention is to provide a brassiere in which margins at the wearer's cleft blend smoothly with the wearer's skin.

Still another object of this invention is to provide a brassiere which is compact and conveniently packaged.

Still another object of this invention is to accommodate brassiere designs which include padding.

Still another object of this invention is to provide a brassiere which requires no sling over the nape of the wearer's neck.

Still another object of this invention is to provide a basic brassiere design which is adaptable for swimwear.

Still another object of this invention is to provide a basic brassiere design which is adaptable to a closure cord extendable across the wearer's back or alternately for a brassiere wearable with a backless dress closure cords which wrap around the wearer's waist so as to be connectable to each other at her front.

Still another object of this invention is to provide a brassiere which is simple to put on and to take off.

Still another object of this invention is to provide a brassiere which is inexpensive, easy to launder, requires no ironing and which keeps its shape through repeated washings and wearings.

Still another object of this invention is to provide a brassiere which looks attractive off the wearer as well as on the wearer and which is suited well otherwise to its intended function.

BRIEF DESCRIPTION OF DRAWINGS

The foregoing as well as other objectives, features and advantages will appear more fully from detailed descriptions of two preferred embodiments of the invention and from claims which follow, all viewed in conjunction with accompanying drawings wherein the same numerical designations refer to like parts and wherein:

DESCRIPTION OF PREFERRED EMBODIMENTS

Figure 1:
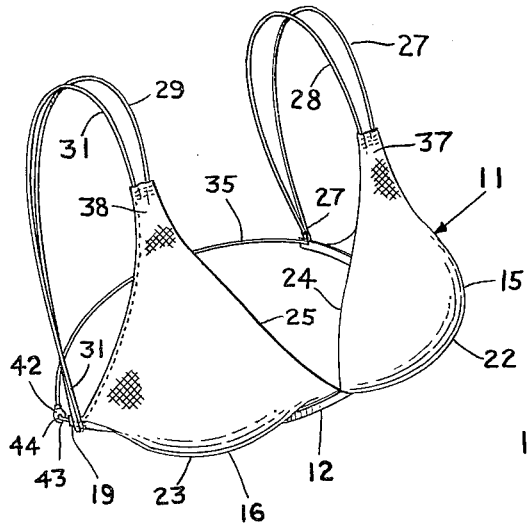
FIG. 1 is a perspective view of a first embodiment of a brassiere according to this invention.
Figure 2:
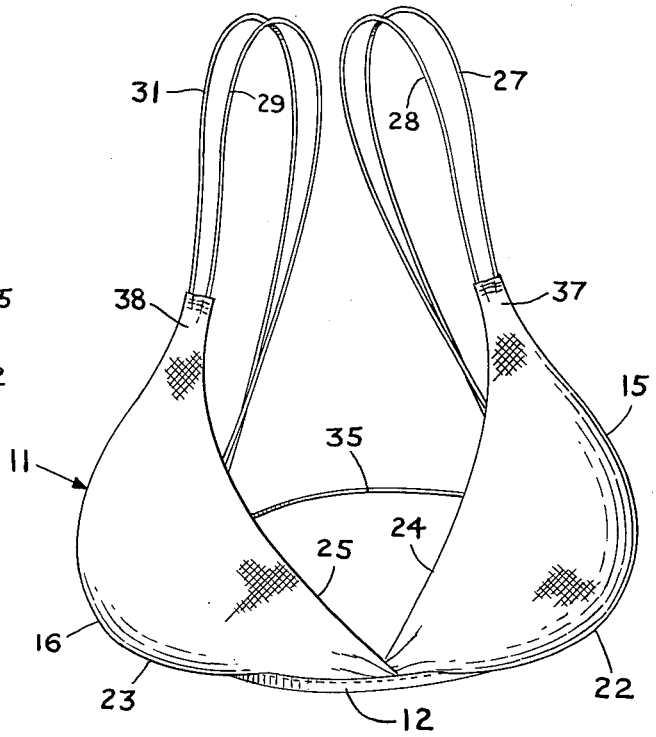
FIG. 2 is a front view of the brassiere of FIG. 1.
Figure 3:
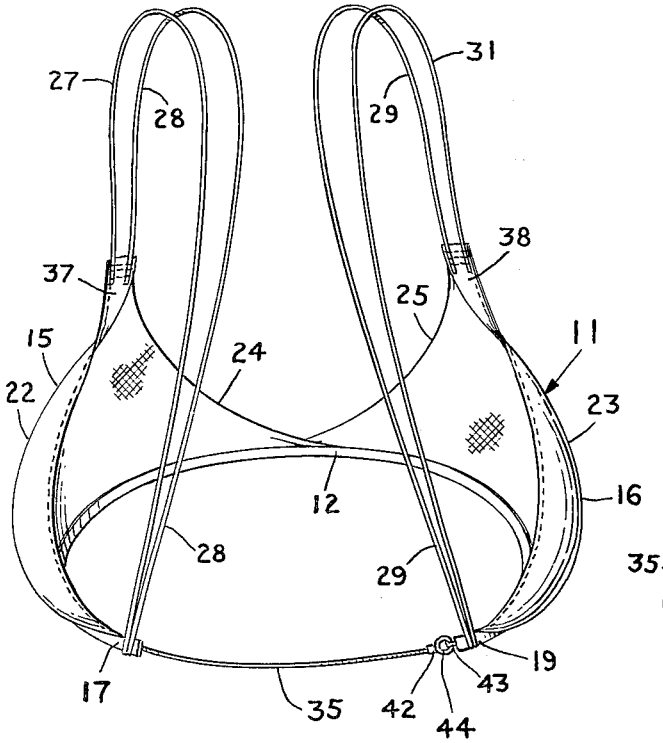
FIG. 3 is a back view of the brassiere of FIG. 1.
Figure 4:
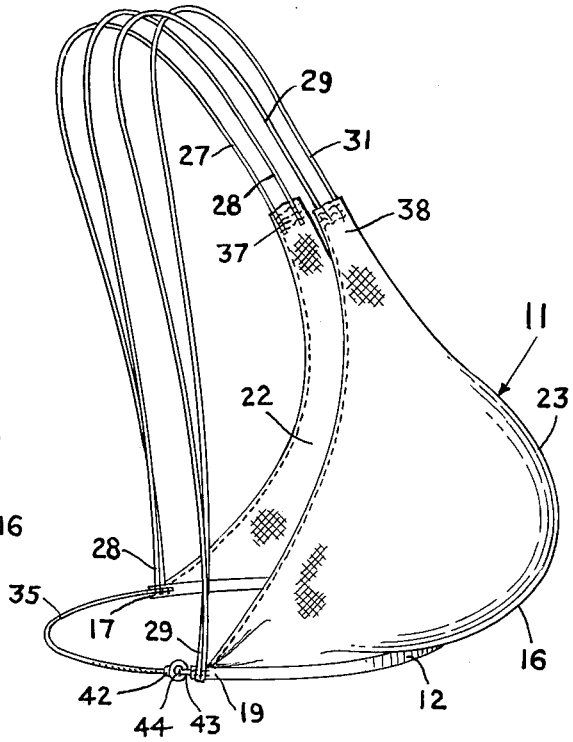
FIG. 4 is a wearer's right side view of the brassiere of FIG. 1, the wearer's left side view being a mirror image of FIG. 4.
Figure 5:
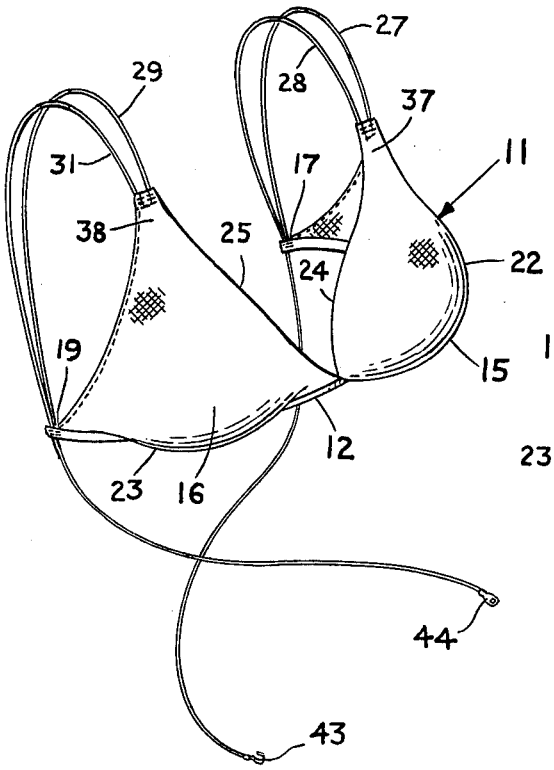
FIG. 5 is a perspective view of a second embodiment of a brassiere according to this invention.
Figure 6:
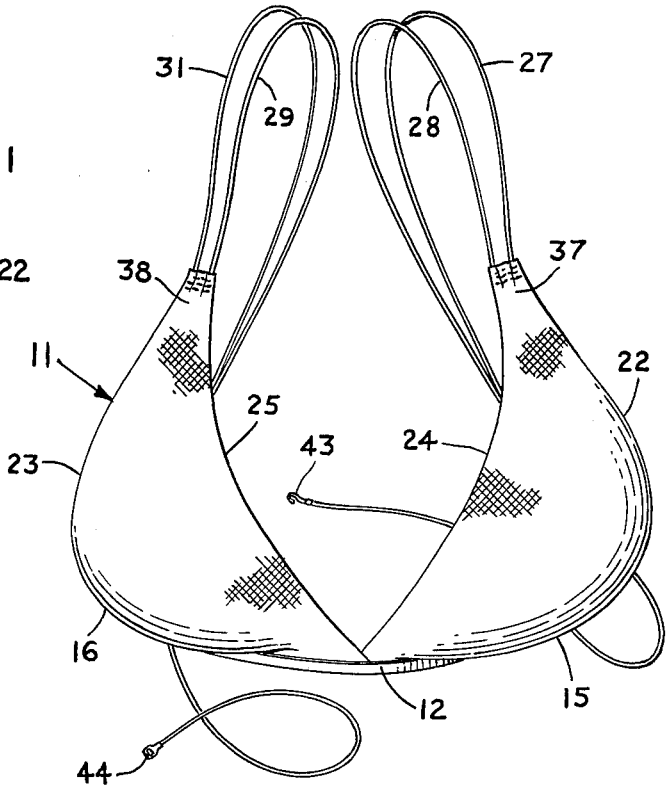
FIG. 6 is a front view of the brassiere of FIG. 5.
Figure 7:
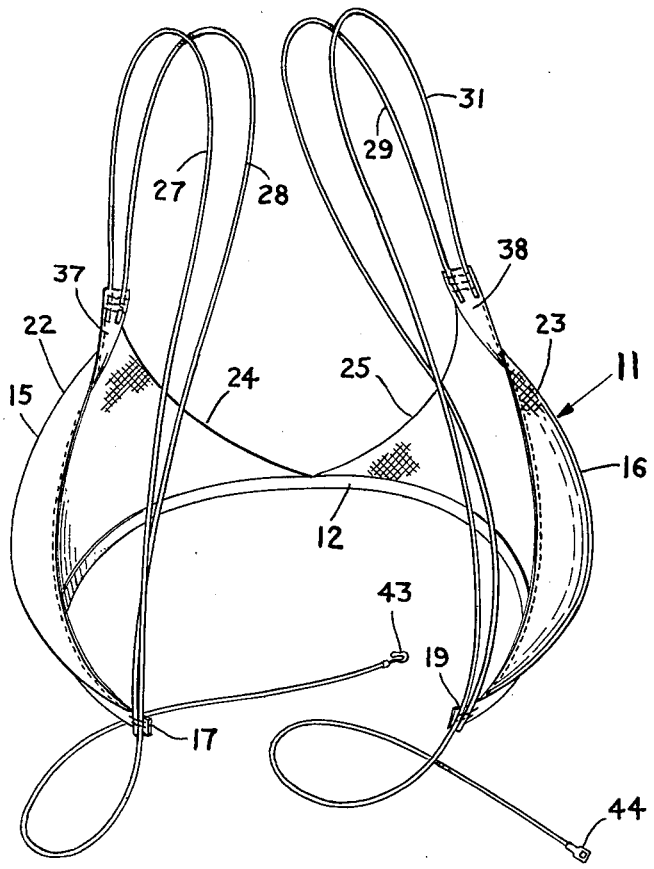
FIG. 7 is a back view of the brassiere of FIG. 5.
Figure 8:
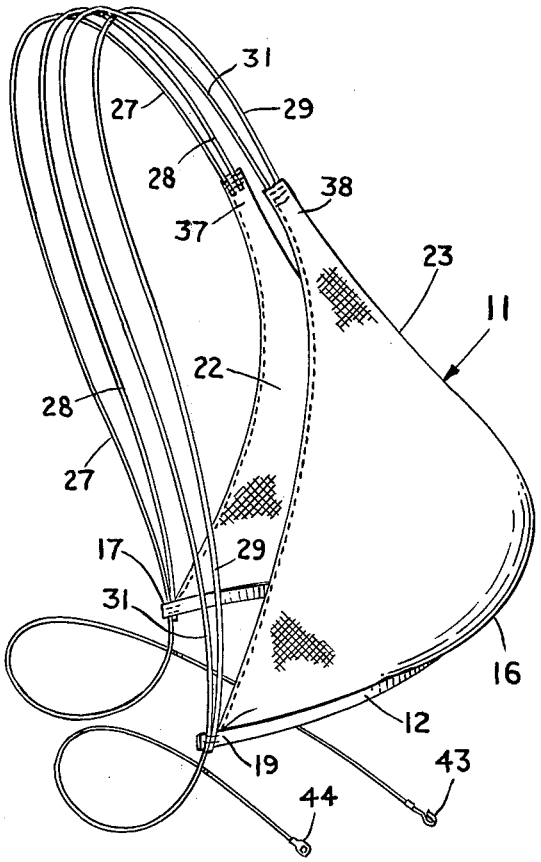
FIG. 8 is a wearer's right side view of the brassiere of FIG. 5, the wearer's left side view being a mirror image of FIG. 8.
Figure 9:
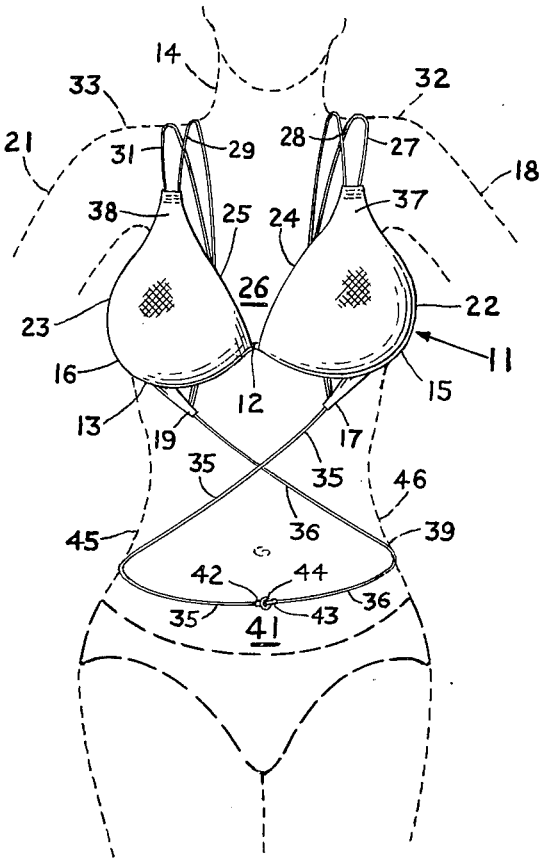
FIG. 9 is a front view of the brassiere of FIG. 5 on a phantomized wearer.
Figure 10:
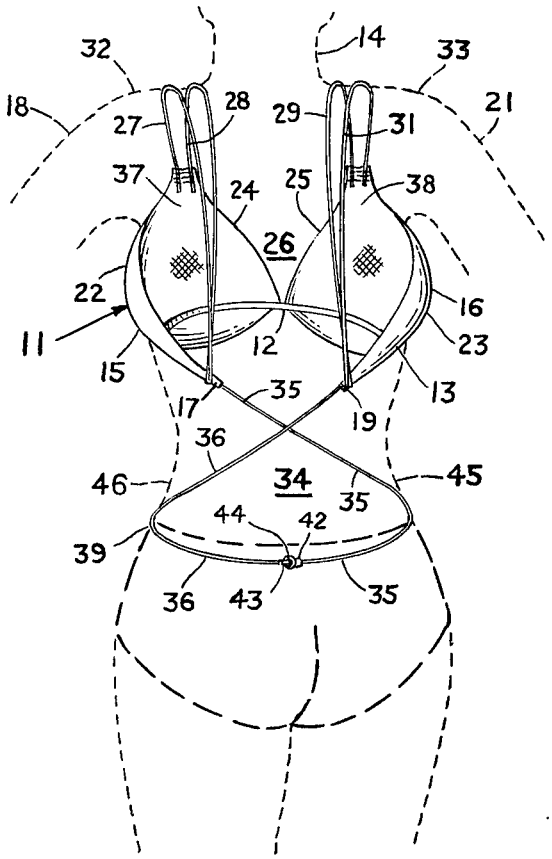
FIG. 10 is a rear view of the brassiere of FIG. 5 on the phantomized wearer.

As seen in the drawings, a brassiere generally designated 11 in accordance with this invention comprises a body engaging band 12 which extends generally horizontally across a chest 13 of a wearer 14 under her breasts (left 15 and right 16) as seen best in FIGS. 9 and 10. The body engaging band 12 terminates in a wearer's left end 17 under the wearer's left arm 18 and a wearer's right end 19 under the wearer's right arm 21.

The brassiere 11 preferably has cups (left 22 and right 23) mounted on the body engaging band 12 and adapted for receiving the wearer's breasts (left 15 and right 16 respectively). The cups 22, 23 preferably are made of a polyester (or like) fabric which is thin and can be molded into cup shapes so that seams can be obviated. A wide variety of brassiere styles may be accommodated, including some motion, impression of the wearer's nipples, padding and so forth. Margins 24, 25 of the cups 22, 23 which are positionable in the vicinity of the wearer's cleft 26 can be unseamed so that the margins 24, 25 tend to blend with the wearer's cleft 26 so that a braless effect is enhanced further. These margins 24, 25 can be treated with a heat settable thermoplastic resin so as to prevent their curling after laundering, even though the polyester (or like) fabric from which the cups 22, 23 preferably are made may be quite sheer.

The crux of the present invention is to use at least two shoulder cords 27, 28, 29, 31 over each of the wearer's shoulders 32, 33. The body engaging band 12 fixes the position of the brassiere 11 relative the wearer's body 14. Having at least two paired shoulder cords 27, 28 or 29, 31 over each of the wearer's shoulders 32, 33 allows division of load from the related breasts 15, 16 between the paired shoulder cords 27, 28 or 29, 31. As the wearer 14 moves her back 34 and her shoulders 32, 33 in such activities as dancing, athletics or the like, her muscles are unrestrained and a major portion of the load from each of her breasts 15, 16 shifts from one of the cords of pairs 27, 28 or 29, 31 to the other of that pair according to her movements. Providing a major portion of the support for her breasts 15, 16 from the pairs 27, 28 or 29, 31 of shoulders cords obviates need for back panels of conventional brassieres. Vastly superior support is also provided by the present invention compared to halter style brassieres. Closure cords 35, 36 come into play to position the ends 17, 19 of the body engaging band 12.

The left cup 22 terminates in a left upper end 37 which connects with at least two of the left shoulder cords 27, 28 spaceable from each other and extendable over the wearer's left shoulder 32 to connect with the left end 17 of the body engaging band 12. The right cup 23 terminates in a right upper end 38 which connects with at least two of the right shoulder cords 29, 31 separable from each other and extendable over the wearer's right shoulder 33 to connect with the right end 19 of the body engaging band 12.

All of the cords 27, 28, 29, 31, 35, 36 are substantially round in cross section (sometimes called spaghetti bands) so that they are relatively undetectable even through very sheer outer garments. The round cross sectioned cords 27, 28, 29, 31, 35, 36 are generally cylindrical with light incident sidewise thereon, accordingly there is only a trace of light intercepted by the cords 27, 28, 29, 31, 35, 36 compared to light intercepted by a flat strap of comparable cross sectional area. Demonstrations and tests have shown that cords 27, 28, 29, 31, 35, 36 of brassiere 11 according to the present invention are virtually imperceptible through even very sheer outer garments.

The brassiere 11 according to this invention is adaptable to a closure cord 35 which extends across the wearer's back 34 as shown in FIGS. 1–4 or for backless dresses closure cords 35, 36 which wrap around the wearer's waist 39 for connection to each other at her front as shown in FIGS. 5–10 and most particularly in FIGS. 9–10. In the embodiment of FIGS. 1–4 at least one closure cord 35 extends across the back 34 of the wearer 14 and the closure cord 35 is removably engageable to an end 19 of the body engaging band 12 by means of a connector 42 which includes a hook 43 and a mating eye 44. In the embodiment of FIGS. 5–10 a left closure cord 35 is connected to the left end 17 of the body engaging band and a right closure cord 36 is connected to the right end 19 of the body engaging band 12. The left closure cord 35 and the right closure cord 36 wrap around the wearer's waist 39 as best seen in FIGS. 9–10 with the left closure cord 35 passing around the wearer's right side 45 and the right closure cord 36 passing around the wearer's left side 46. The left 35 and right 36 closure cords are connectable to each other in front of the wearer by means of a connector 42 which includes a hook 43 and a mating eye 44. Clearly in both the embodiments of FIGS. 1–4 and FIGS. 5–10 the hook 43 and the mating eye 44 of connector 42 accommodate convenient putting on and taking off of the brassiere 11 according to this invention by positioning the connector 42 at one end 19 of the body engaging band 12 in the embodiment of FIGS. 1–4 and in front 41 of the wearer 14 in the embodiment of FIGS. 5–10.

The shoulder cords 27, 28, 29, 31 and the closure cords 35, 36 require no ironing and neither do the molded sheer polyester (or like) cups 22, 23. The brassiere 11 is quite easy to launder. Further the brassiere 11 will keep its shape through repeated washings and wearings.

Brassieres are notorious for their dowdy appearance off the body 14 of a wearer. Unpackaged on store counters, as well as around a boudoir, brassieres are not the most attractive of lingerie. In fact few items of lingerie require a wearer for their forms as much as do brassieres. Note that in advertisements a brassiere is hardly ever seen apart from its wearer. However, the molded cups 22, 23 and the spaghetti cords 27, 28, 29, 31, 35, 36 as well as the simple compact connector 42 of this brassiere yield an intriguing appearance and facilitiate packaging.

It will be apparent to those skilled in fashions and brassiere designs that wide deviations may be made from the shown and described preferred embodiments of brassiere 11 according to this invention which is illustrative rather than limiting, without departing from a main theme of invention set forth in the claims which follow.

I claim:

1. A brassiere comprising:

a body engaging band extendable across a wearer's chest under her breasts and terminating in a left end under the left arm of the wearer and a right end under the right arm of the wearer, a left and a right cup both connected to the band and adapted for receiving the wearer's left and right breasts respectively, the left cup terminating in a left upper end which connects with at least two left shoulder cords spaceable from each other and extendable over the left shoulder of the wearer to connect with the left end of the body engaging band, the right cup terminating in a right upper end which connects with at least two right shoulder cords separable from each other and extendable over the right shoulder of the wearer to connect with the right end of the body engaging band, at least one closure cord connecting the left and the right ends of the band to each other.

2. The brassiere according to claim 1 wherein all of the cords substantially round in cross section.

3. The brassiere according to claim 2 wherein the cups are made of polyester fabric molded to shape without seams.

4. The brassiere according to claim 3 with margins of the cups, which are positionable in the vicinity of the wearer's cleft, being unseamed.

5. The brassiere according to claim 4 with the margins of the cups, which are positionable in the vicinity of the wearer's cleft, being treated with a heat settable thermoplastic resin to prevent their curling.

6. The brassiere according to claim 2 with the closure cord extending across the back of the wearer.

7. The brassiere according to claim 6 with the closure cord removably engageable to one of the ends of the body engaging band by means of a hook and eye connector.

8. The brassiere according to claim 2 with a left closure cord connected to the left end of the body engaging band and a right closure cord connected to the right end of the body engaging band, the left closure cord and the right closure cord wrapped around the wearer's waist with the left closure cord passing around the wearer's right side and the right closure cord passing around the wearer's left side, the left and the right closure cords connectable to each other in front of the wearer.

9. The brassiere according to claim 8 with the left and the right closure cords removably engageable from each other by means of a hook and eye connector.

* * * * *